US009144732B2

(12) United States Patent
Just

(10) Patent No.: US 9,144,732 B2
(45) Date of Patent: Sep. 29, 2015

(54) CODED PLAYING CARDS

(75) Inventor: Peter Just, Copenhagen N (DK)

(73) Assignee: BRIDGE COMPANY A/S, Soborg (DK)

( * ) Notice: Subject to any disclaimer, the term of this patent is extended or adjusted under 35 U.S.C. 154(b) by 79 days.

(21) Appl. No.: 12/734,288

(22) PCT Filed: Nov. 13, 2008

(86) PCT No.: PCT/DK2008/000404

§ 371 (c)(1),
(2), (4) Date: May 5, 2010

(87) PCT Pub. No.: WO2009/062513

PCT Pub. Date: May 22, 2009

(65) Prior Publication Data

US 2012/0018951 A1 Jan. 26, 2012

(30) Foreign Application Priority Data

Nov. 13, 2007 (DK) ..... 2007 01603

(51) Int. Cl.

| | |
|---|---|
| ***A63F 1/00*** | (2006.01) |
| ***A63F 1/02*** | (2006.01) |
| *A63F 9/06* | (2006.01) |
| *A63F 9/24* | (2006.01) |

(52) U.S. Cl.
CPC ..... *A63F 1/02* (2013.01); *A63F 2009/0609* (2013.01); *A63F 2009/242* (2013.01); *A63F 2009/2419* (2013.01)

(58) Field of Classification Search
CPC ..... A63F 1/00
USPC ..... 273/292
See application file for complete search history.

(56) References Cited

U.S. PATENT DOCUMENTS

| | | | | |
|---|---|---|---|---|
| 5,259,907 | A | 11/1993 | Soules et al. | |
| D350,781 | S | 9/1994 | Jannersten | |
| 6,527,191 | B1 | 3/2003 | Jannersten | |
| 7,492,267 | B2 * | 2/2009 | Bilyeu et al. | 340/573.1 |
| 7,674,182 | B2 * | 3/2010 | Gauselmann | 463/42 |
| 7,727,060 | B2 * | 6/2010 | Mills | 463/13 |
| 7,866,550 | B2 * | 1/2011 | Clegg et al. | 235/380 |
| 8,033,548 | B2 * | 10/2011 | Shigeta | 273/293 |
| 8,092,293 | B2 * | 1/2012 | Richards et al. | 463/17 |

(Continued)

FOREIGN PATENT DOCUMENTS

EP 1 316 341 A1 6/2003

OTHER PUBLICATIONS

International Search Report issued in Application No. PCT/DK2008/000404; Mailed on May 6, 2009.

(Continued)

*Primary Examiner* — Michael Dennis
*Assistant Examiner* — Dolores Collins
(74) *Attorney, Agent, or Firm* — Oliff PLC

(57) ABSTRACT

A playing card provided with identification code which is arranged along opposed long sides of the card and mutually symmetrically. Each code comprises at least six code fields of essentially equal size that occupy a significant area of the rim area of the respective edges of the card. According to a preferred embodiment, the codes are provided in that the surface of the entire playing card is reflective of ultraviolet light, where the surface has been de-masked to define the code fields.

8 Claims, 4 Drawing Sheets

(56) References Cited

U.S. PATENT DOCUMENTS

| | | | | |
|---|---|---|---|---|
| 2004/0026636 | A1* | 2/2004 | Shigeta | 250/556 |
| 2005/0156046 | A1 | 7/2005 | Goldenberg | |
| 2005/0287925 | A1* | 12/2005 | Proch et al. | 446/470 |
| 2006/0247036 | A1 | 11/2006 | Shigeta | |
| 2007/0225055 | A1* | 9/2007 | Weisman | 463/11 |
| 2011/0106699 | A1* | 5/2011 | Clegg et al. | 705/41 |

OTHER PUBLICATIONS

Written Opinion of the International Searching Authority issued in Application No. PCT/DK2008/000404; Mailed on May 6, 2009.

* cited by examiner

CODED PLAYING CARDS

The invention concerns playing cards with identification codes for automatically detecting the index and value of the cards, wherein, along each of the opposed long sides of the card, mutually symmetrical codes are provided.

Such kind of code for playing cards is known from various patent disclosures, eg U.S. Pat. No. 6,527,191, U.S. D350, 781 and U.S. Pat. No. 5,259,907.

The known methods of coding playing cards are thus all based on a conventional bar code that entails a mutual movement between the bar code and the associated detector. Either by the card being moved relative to the detector or by the detector being movable or comprising a beam that can be moved across the bar code.

The invention is intended for use in particular in the context of an apparatus for automatically handing out playing cards, which apparatus is to be as compact and noiseless as at all possible.

All of the known methods of detecting the index and value of the playing cards are based on said relative movement which means that the detector takes up comparatively much space.

US 2006/0247036 A1 also teaches playing cards intended for a detection method like the above-mentioned prior art; however, that disclosure also comprises an embodiment by which one card at a time is introduced manually into a slot that has positioning means for ensuring reliable manual positioning of a card to the effect that the codes on the card can be read statically, albeit the code marks are not larger than the ones used for dynamic detection.

The invention is based on the discovery that the known playing cards are not suitable for static and automatic reading in an apparatus where the stack of cards is to be arranged in a magazine in the apparatus following which the cards are discharged individually by means of an ejector mechanism. Owing to space considerations as mentioned above it is necessary to operate with fixed detectors that in turn require that the code fields are positioned correctly relative to the detectors in all circumstances, ie that all inaccuracies that may occur have been taken into consideration. For instance, it is necessary that the cards are positioned relatively loosely in the magazine in order for them not to get caught while being ejected, and thereby problems will occur in respect of the positioning accuracy if the known kinds of coding of playing cards are used.

Moreover, it is not practically viable to introduce the cards automatically in a slot as it known from the latter US disclosure. The coded fields of the cards must therefore be exposed, which increases the risk of false light disturbing the detection—as a kind of crosstalk. Therefore there is a need for a coding for playing cards that comply with a number of requirements that have so far not been relevant.

The object of the invention is to provide a playing card with an identification code that allows both a stationary detection and that the detection is considerably less sensitive to inaccurate positioning than the known kinds of code.

This object is obtained in that each code contains six code fields of substantially the same size that combine to occupy at least one fifth of the length of the card. Thereby each of the code fields is caused to be of such size that the detection may consist of a stationary detector for each code field without there being a risk of erroneous readings when the cards sit loosely in a magazine, where they have a certain mobility and distance relative to the detectors. Thereby the fields also become so large that there is no risk of a detector coming close to a neighbouring code field. Moreover, the playing card according to the invention is insensitive to blurring of colour or coding substance into the adjacent area between the code fields.

The paper on which the playing cards are printed may be a paper quality which is impregnated with additional amounts of optical white to provide a powerful UV effect. Then a UV blocking, invisible mask is applied which does not, like UV colour, diffuse into the paper, but rather maintains a sharp masking which yields clear and distinctly marked detection fields.

In order to ensure long durability of the detection fields and hence an operationally reliable solution, a coating is applied onto the cards. Either by a coating being imprinted thereon, or by a pvc-coating being applied thereon by melting.

Preferably the total area of the code fields constitutes at least half of the respective rim area. This is different from usual bar codes where the total area of the bars is considerably smaller than the respective code area. By rim area of the card is intended the area from the edge and inwards to the central area of the card which is usually occupied by a depiction or the number of spades, hearts, diamonds or clubs corresponding to the value of the card.

The code fields can be arranged in several rows in parallel with the rim of the card, but preferably they are arranged in one row along the rim of the card, whereby the expanse of the detector across the card can be reduced.

As mentioned, the invention is intended for use in particular in the context of an apparatus for handing out playing cards, and in such apparatus the cards are to be guided/secured during the handing-out procedure. The means for doing so usually extends down below the card/the stack of cards and by a preferred embodiment there will thus be an empty field on the card which is not covered by any detector and where control or holding means for the cards can thus be arranged. By a preferred embodiment the cards are maintained/guided centrally on the long side, and three code fields are provided on each their side of that area.

The code fields may be provided with a colour code, which, however, will often constitute a nuisance to the players, which is why it is preferred to use invisible coding that fluoresces upon irradiation with ultraviolet light.

There is a particular combinatory advantage of using the large code fields according to the invention, entailing firstly insensitivity to inaccuracies in the positioning of the card relative to the detector, the large code fields being an advantage in the context of the fluorescent coding. By that technique the intensity of the fluorescent light is comparatively small, but precisely by the code fields of the invention being large, reliable detection can be performed.

The relatively large code fields can also be used to advantage by positioning tags in the code fields, eg electronic resonance circuits. The latter invisible code fields could easily extend further into the card, ie within said rim area. For instance, it is possible in accordance with the invention to combine invisible, fluorescent coatings and tags, and there will be plenty of space for positioning multiple detectors in said magazine.

Of course, the code fields must have a sufficient expanse transversally to the long sides of the card. In that direction there is no issue regarding space, but typically the fields will be essentially square, said tolerances applying as a starting point to both directions.

The invention will be explained in further detail in the following description of an embodiment, reference being made to the drawing, wherein FIG. 1 shows a playing card with an embodiment of a code according to the invention;

FIG. 3 shows a magazine for playing cards in an apparatus for handing out playing cards; while

Initially, an example will be given of tolerance conditions that substantiate the invention.

In order to be able to perform a static reading where both the cards are static and the reader is static, the fields must be configured such that several conditions concerning tolerance are taken into account. A tolerance originates in the cutting/punching of the cards. Here the manufacturers typically set forth that their tolerance is +/−1/32 inch, corresponding to +/−0.8 mm. Another tolerance is the compartment in which the cards are deployed. The card compartment must be 2 mm larger than the card as a minimum in order to allow deployment of the card into the card compartment and to ensure that the card does not get stuck in the compartment in case the card expands slightly upon the influence of humidity. Moreover, there is a tolerance inasmuch as the reader as such is concerned. Both a structural tolerance (arrangement of component), but also a tolerance brought about by the reader being situated a couple of millimetres away from the detection field as such, and thus false light may enter upon illumination of the fields. This is typically +/−0.8 mm. The total tolerance therefore amounts to 5.2 mm.

Moreover, it is a fact that it is impossible to use UV coding on top of artwork in a static detection as it interferes negatively with the detection. By static reading, the base must be a solid colour base, preferably white, to obtain the best signal to noise ratios in the coding. Therefore, space for intarsia should also be deducted at the corners (2 by 21 mm). Moreover, space should also be deducted to allow for the card to lie in a point that enables it to be ejected from the compartment in a reliable manner. That point is assumed to be 3 mm. A bridge-size card is 57 by 89 mm, and thus, in a worst case scenario, there remains only 44 mm for six code fields. That allows for a maximum per code field of 7.3 mm.

When, as indicated above, one deducts the tolerance (7.3 mm−5.2 mm), there is thus, in a worst case scenario, 2.1 mm left for performing a reliable detection. Or, in other words, one uses merely 6 by 5.2 mm=31.2 mm to compensate for tolerances in case of static reading. Therefore the invention consists in realising that the space needed for the total width of the code fields is at least one fifth of the length of the card.

Figure 1:
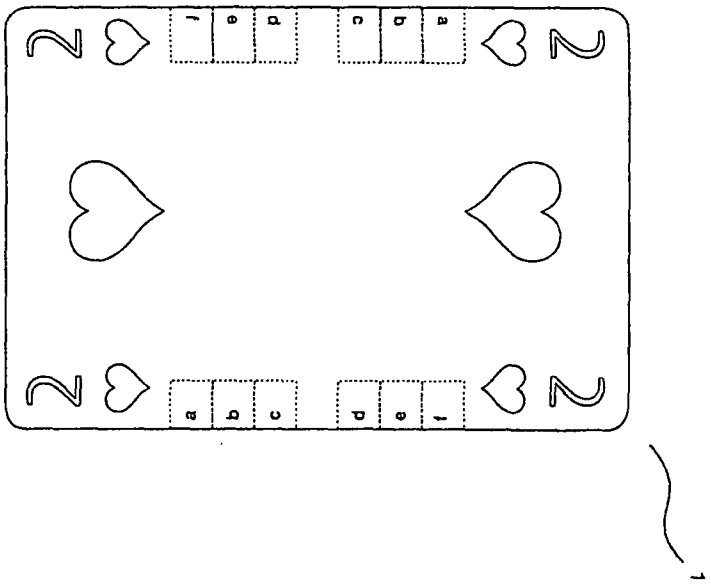
Figure 4:
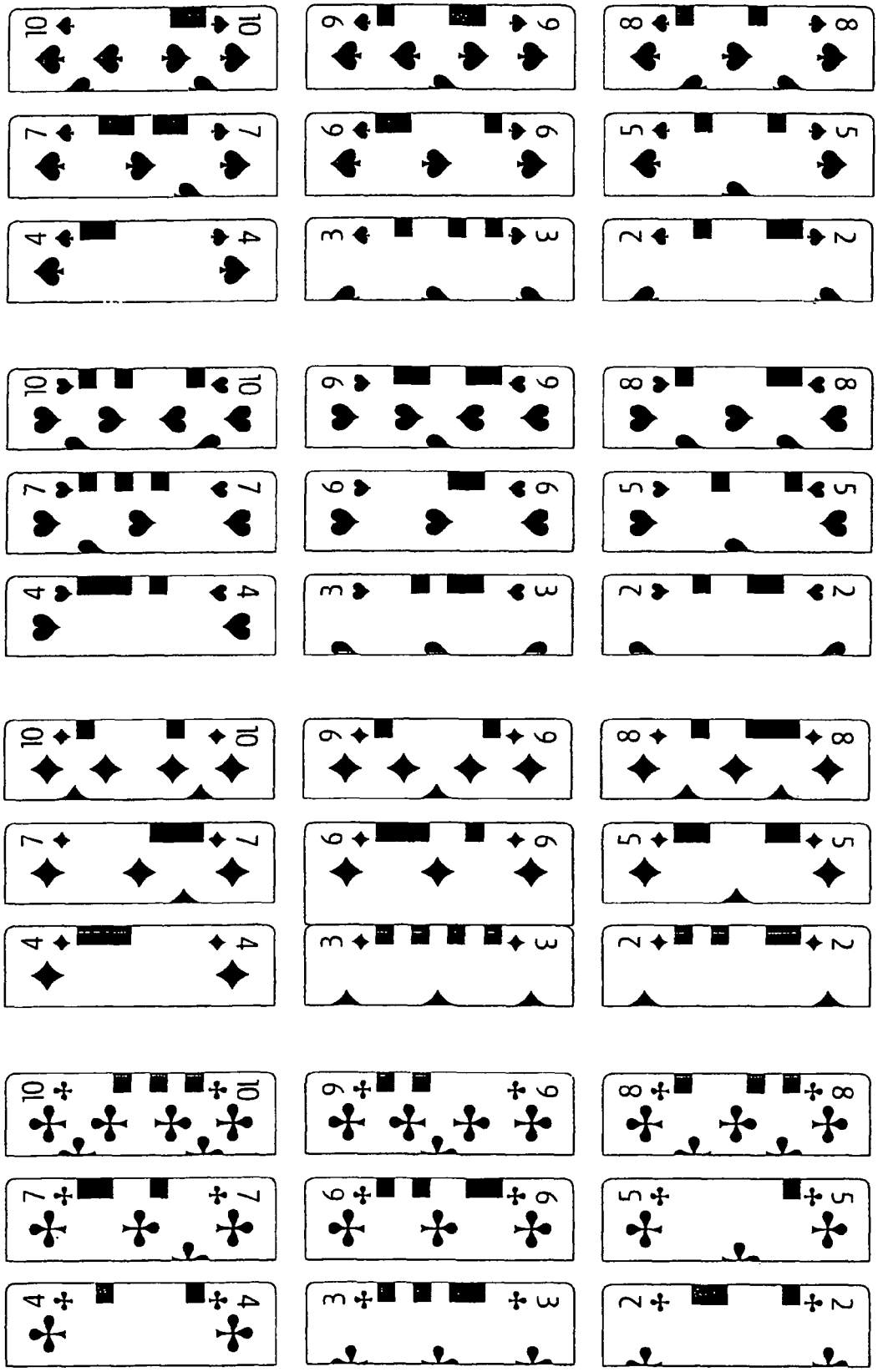
FIG. 4 shows examples of coding of the playing cards.

FIG. 1 shows a playing card 1. It is suggested that two of hearts could be concerned, but it could be any other card. What matters is that a code is present in the form of six code fields a-f on the opposing long sides of the cards, and those codes are filled in in a manner that is characteristic to a specific card, see also FIG. 4. FIG. 4 shows how the fields a-f can be filled in with black dye or not, but in practice some kind of invisible code is used which can, however, be detected automatically. The code according to the invention is particularly suitable for a static detection, and it will be understood that the codes a-f along the opposed long sides of the card are mutually symmetrical to the effect that the card can be detected no matter how it is oriented relative to the detectors.

It is also within the framework of the invention that fields d-f in FIG. 1 could be situated in the second row, ie be located behind the row a-c, or be distributed in some other way as long as their total width is at least one fifth of the total length of the card.

Figure 2:
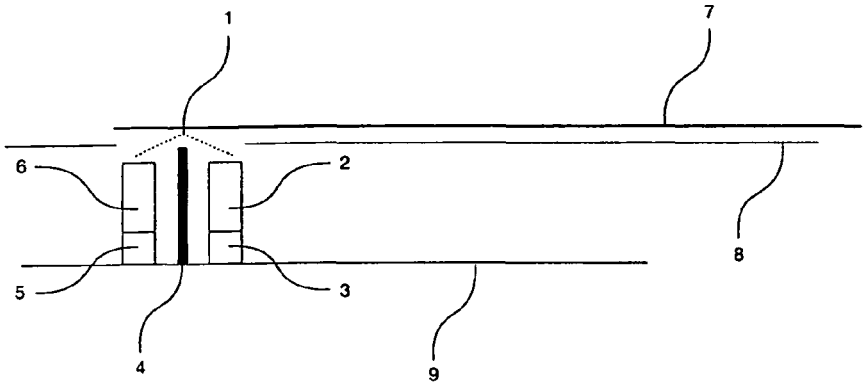
FIG. 2 shows a schematic detection device.

FIG. 2 shows the card 1 according to FIG. 1 arranged on the bottom 8 of a card magazine. Typically an entire stack of cards will be situated on the bottom 8. The bottom 8 is provided with an opening 9, and below this, detection means are provided for the index and value of the card. By the preferred embodiment a material has been applied onto the cards that fluoresces upon irradiation with ultraviolet light, and, in the context of FIG. 2, a detector will be explained for detection of such code.

The detector comprises a UV light source 3 and an optical fibre rod 2 that distributes the light and transmits it towards the card 1. The fields onto which fluorescent material has been applied will emit fluorescent light that is captured in an optical fibre rod 6 and is conducted to sensors that are arranged entirely in accordance with the code fields a-f on the card 1. Typically, the detector will be arranged on a circuit card 4.

Figure 3:
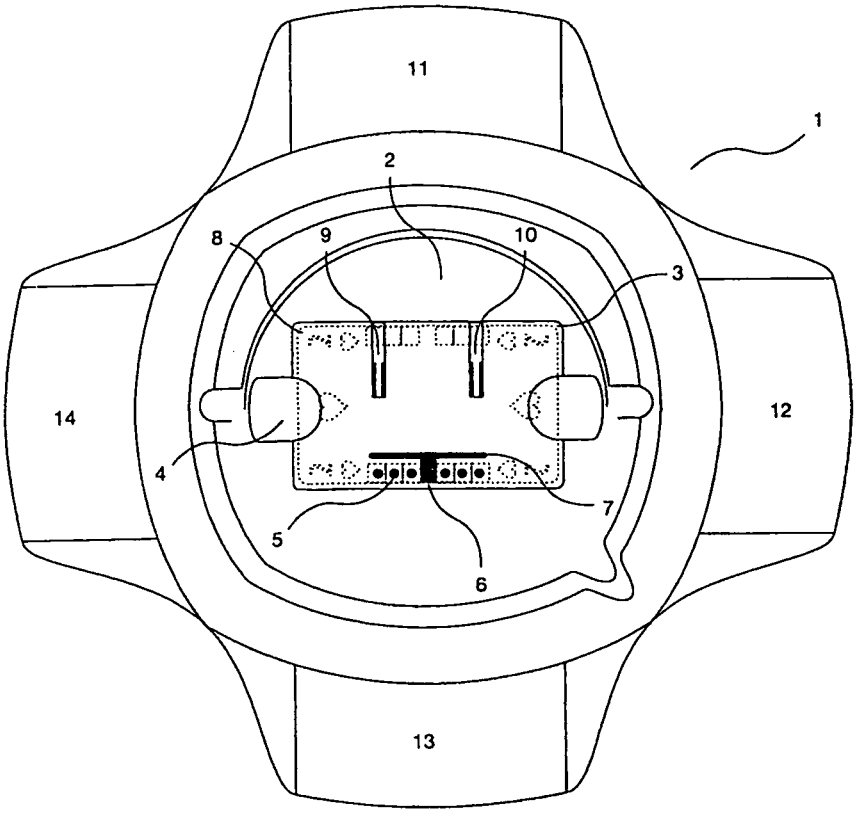

It will be understood that this technique necessitates relatively large code fields a-f, both due to the configuration of the detector and the use of the relatively weak fluorescent light. This is also in accordance with another condition that applies to the use of the card according to the invention, viz that the card magazine (which is seen in FIG. 3) is oversized relative to the rim of the cards, see the dotted line in FIG. 1. It is necessary to provide a certain tolerance to the effect that the cards are able to move a bit in the magazine so as to prevent them from getting stuck during the discharge.

FIG. 3 is a schematic view of an apparatus for handing out playing cards. The cards can be delivered into four magazines 11-14. FIG. 3 is drawn such that one looks into a magazine that comprises engagement holes 5 and wherein a dotted line suggests that two of hearts is sitting with its face side facing downwards. At the bottom of the magazine 15, various means are provided for ejecting cards and for detecting the code fields which will be described in the following.

FIG. 3 shows the light emitter 3 and the detectors 5, see the explanation to FIG. 2. A carrier beam 16 is also shown that carries the cards with little friction to the effect that the cards can be ejected from the bottom of the magazine by means of ejector arms 17, 18 that are movable transversally of the long side of the cards and are configured for pushing a card outwards in a direction towards the card drawer 11. The apparatus is configured such that the entire magazine turns and assumes a position which is determined by the code fields, whereby a specific card is delivered to a specific one of the magazines 11-14.

To avoid that the cards get stuck during the performance procedure, it is necessary that further said clearance or tolerance between the outer dimensions of the cards and the magazine 15 is provided. The large code fields according to the invention are therefore particularly convenient for use in the context of the above-referenced magazine for a handing-out apparatus.

FIG. 4 shows examples of coding of the code fields according to the invention. If a number of neighbouring fields have been marked, they may diffuse into one coherent field which the detector may be insensitive to as explained in the context of FIGS. 2 and 3. However, it is preferred to use invisible codes, eg by the code fields being filled with a substance that fluoresces upon exposure to UV illumination, see the explanation given in the context of FIG. 2. The large code fields according to the invention also allow that one might use eg tags in the form of electronic resonance circuits. That kind of code can be used alone or in combination with other kinds of code, and it will be understood that, if the code is not visible, it will be possible for it to extend further on the cards than shown in FIG. 4, since state-of-the-art playing cards are made by lamination of a number of layers that are able to conceal eg electronic tags.

The invention claimed is:

1. A playing card with an identification code for automatic detection of an index and a value of the card, wherein:

the identification code is provided mutually symmetrically along each of opposed, long sides of the card, the identification code along each of the long sides of the card includes six code fields ("a"-"f") of substantially the same size that occupy in combination at least one fifth of a length of the card, the code fields are filled in a manner that is characteristic to a specific card, at least one first code field of the code fields is filled with a substance that fluoresces upon exposure to UV illumination and at least one second code field of the code fields fluoresces less upon exposure to the UV illumination than the at least one first code field, and the code fields are arranged such that:

the code field "a" of the identification code on one of the long sides of the card and the code field "f" of the identification code on the other one of the long sides of the card are arranged opposite to each other on either side of a longitudinal center axis of the card, the code field "b" of the identification code on one of the long sides of the card and the code field "e" of the identification code on the other one of the long sides of the card are arranged opposite to each other on either side of the longitudinal center axis of the card, and the code field "c" of the identification code on one of the long sides of the card and the code field "d" of the identification code on the other one of the long sides of the card are arranged opposite to each other on either side of the longitudinal center axis of the card.

2. A playing card according to claim 1, wherein a total area of the code fields constitute at least half of a respective rim area.

3. A playing card according to claim 1, wherein the code fields are all situated close to a rim of the card.

4. A playing card according to claim 1, wherein a smaller amount of a rim area of the card is free from code fields.

5. A playing card according to claim 4, wherein, around a middle of the opposed long sides, an area is provided which is free from code fields; and three code fields are arranged at each side of said area.

6. A playing card according to claim 1, wherein the code fields extend a distance into the card within a rim area.

7. A playing card according to claim 1, wherein the code fields are square.

8. A playing card according to claim 1, wherein the code fields of the identification code arranged along the long sides of the card are arranged such that a line connecting the code field "a" of the identification code arranged on one long side of the card and the code field "f" of the identification code arranged on the other long side of the card would be perpendicular to the longitudinal axis of the card.

* * * * *